US007207874B2

(12) United States Patent
Bohne et al.

(10) Patent No.: US 7,207,874 B2
(45) Date of Patent: Apr. 24, 2007

(54) ELECTRIC HAND POWER TOOL

(75) Inventors: Ulrich Bohne, Kohlberg (DE); Eugen Hild, Aichtal (DE); Heiko Roehm, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/318,968

(22) Filed: Dec. 27, 2005

(65) Prior Publication Data

US 2006/0141914 A1 Jun. 29, 2006

Related U.S. Application Data

(63) Continuation-in-part of application No. 10/719,753, filed on Nov. 21, 2003, now abandoned.

(30) Foreign Application Priority Data

Nov. 22, 2002 (DE) ..... 102 54 578
Feb. 7, 2003 (DE) ..... 103 05 034

(51) Int. Cl.
*B24B 55/04* (2006.01)
*B27B 21/00* (2006.01)

(52) U.S. Cl. ..... 451/359; 451/451; 30/516; 30/520

(58) Field of Classification Search ..... 451/357, 451/358, 359, 451; 30/516, 517, 520
See application file for complete search history.

(56) References Cited

U.S. PATENT DOCUMENTS 1,749,705 A * 3/1930 Hudspith ..... 451/353
2,418,429 A * 4/1947 Sauer ..... 112/281
4,281,457 A * 8/1981 Walton, II ..... 30/124
4,414,743 A * 11/1983 Pioch et al. ..... 30/124
5,077,942 A * 1/1992 Jacobsson ..... 451/344
5,315,193 A * 5/1994 Kummer et al. ..... 310/50
5,595,532 A * 1/1997 McCracken ..... 451/357
6,447,387 B1 * 9/2002 Tseng ..... 451/456
6,543,549 B1 * 4/2003 Riedl et al. ..... 173/216
6,688,349 B2 * 2/2004 Stoeger et al. ..... 144/154.5

FOREIGN PATENT DOCUMENTS

| | | |
|---|---|---|
| DE | 644011 | 4/1937 |
| DE | 40 03 029 | 8/1991 |
| DE | 199 24 552 | 11/2000 |
| EP | 0 979 711 | 2/2000 |

* cited by examiner

*Primary Examiner*—M. Rachuba
(74) *Attorney, Agent, or Firm*—Michael J. Striker

(57) ABSTRACT

An electric hand power tool has a housing, an air-cooled electric motor which is accommodated in the housing, a tool which is driven by the electric motor a protective hood which at least partially covers the tool, the housing having a handle and an auxiliary handle for a two-hand guidance of the hand power tool, the auxiliary handle being positioned in a plane transverse to a plane of the first-mentioned handle and, with reference to a work direction, before the first-mentioned handle, the auxiliary handle being completely hollow and having an inlet communicating with the protective hood so as to carry motor cooling air which has left the housing and passed the protective hood for the tool and then flows into the inlet of the auxiliary handle carrying debris and through the auxiliary handle and out of the latter, so that the auxiliary handle is operative for damping a flow noise of the air from the electric motor, from a motor-cooling fan and from the tool.

7 Claims, 3 Drawing Sheets

ELECTRIC HAND POWER TOOL

CROSS REFERENCE TO A RELATED APPLICATION

This application is a continuation-in-part of patent application Ser. No. 10/719,753 filed on Nov. 21, 2003 now abandoned.

CROSS-REFERENCE TO PRIORITY DOCUMENTS

The invention described and claimed herein below is also described in DE 10254578.2, filed Nov. 22. 2002 and DE 10305034.5, filed Feb. 7, 2003. These German Patent Applications, whose subject matter is incorporated here by reference, provide the basis for a claim of priority of invention under 35 U.S.C. 119 (a)–(d).

BACKGROUND OF THE INVENTION

The present invention relates to an electric hand power tool.

In electric hand power tools, air required for cooling of an electric motor is aspirated by an air impeller, which is fixedly arranged on the driven shaft of the electric motor, through an inlet slot in the power tool housing and blown through outlet slots into the power tool housing. Air which is supplied by the air vanes of the impeller wheel flows on the outlet edges of the outlet slots with high speed, resulting in intense noise generation in an unpleasant high frequency region.

SUMMARY OF THE INVENTION

Accordingly, it is an object of the present invention to provide an electric hand power tool of the above mentioned general type, which avoids the disadvantages of the prior art.

In keeping with these objects and with others which will become apparent hereinafter, one feature of the present invention resides, briefly stated, in an electric hand power tool, comprising a housing; an air-cooled electric motor which is accommodated in said housing; a tool which is driven by said electric motor a protective hood which at least partially covers said tool; said housing having a handle and an auxiliary handle for a two-hand guidance of the hand power tool, said auxiliary handle being positioned in a plane transverse to a plane of said first-mentioned handle and, with reference to a work direction, before said first-mentioned handle, said auxiliary handle being completely hollow and having an inlet communicating with said protective hood so as to carry motor cooling air which has left said housing and passed said protective hood for the tool and then flows into said inlet of said auxiliary handle carrying debris and through said auxiliary handle and out of the latter, so that said auxiliary handle is operative for damping a flow noise of said air from said electric motor, from a motor-cooling fan and from said tool.

When the electric hand power tool is designed in accordance with the present invention, it has the advantage that by the withdrawal of the spent air which leaves the electric motor through the hollow auxiliary handle, on the one hand the air noise is dampened in particular the unpleasant high frequency region is lowered, and on the other hand the spent air is supplied outside away from the operator, so that it does not blow on the operator during the operation of the machine.

In accordance with a preferable embodiment of the invention, the air passage is formed in the housing and provided with an air inlet opening for the motor spent air, which opens into the inlet of the auxiliary handle. With this closed air passage, the path between the impeller vanes of the motor impeller sitting on the motor shaft and the inlet of the auxiliary handle is bridged and thereby a good damping of the flow noise is obtained.

In accordance with a preferable embodiment of the present invention, the air passage is formed screw-shaped or spiral-against shaped with an inner diameter which continually increases toward the inlet of the hollow auxiliary handle. Thereby the channel operates as an unloading space, whereby a high air quantity with a reduced flow speed can be transported for additionally significantly reducing the noise generation. The screw-shaped construction is advantageous for the case, in which the rotary direction of the electric motor and thereby of the motor impeller is opposite to the rotary direction of the tool.

In accordance with a further embodiment of the invention, the auxiliary handle or an outlet pipe which surrounds an outlet of the auxiliary handle is formed turnable. Thereby the outflow of the motor spent air is adjusted so that it can not flow unpleasantly to the operator in any work application. With the auxiliary handle which is turnable and arrestable in the adjusted turning position, it is possible to provide an individual optimization of the ergonomics of the power tool by adaptation to individual gripping habits of the operator.

In accordance with a preferable embodiment of the present invention, the hollow auxiliary handle is formed as a bracket handle, which in the electric hand power tool with a rotatable tool at least partially covered by a protective hood, is placed with one handle end on the protective hood, while at or near its another end it is fixed on a housing part of the housing which accommodates the electric motor, and its inlet is located under the protective hood. Thereby a solid mechanical connection of the auxiliary handle with the housing is provided and because of the immanently great handle region of a bracket handle, a reliable handling of the power tool both for a left-handed and right-handed person is possible, which provides also a flexible handle position in different work applications.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
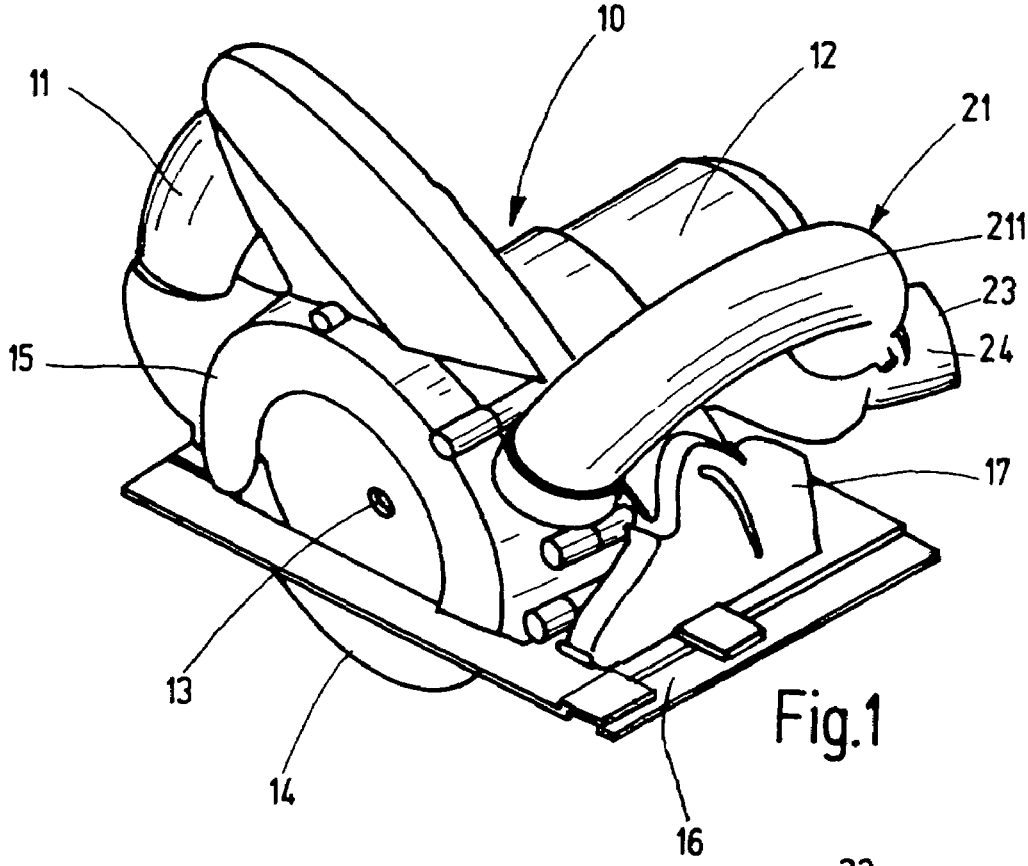
FIG. 1 is a view showing an electric hand circular power saw in accordance with the present invention.

An electric hand circular power saw is shown in the drawings as an example for an electric hand power tool for chip-removing or grinding treatment of work pieces. It has a two-shell housing 10 with a handle 11 formed on it for guiding and handling of the power tool and with a motor housing 12 placed on it and accommodating an air-cool electric motor.

The electric motor drives a drive shaft 13 through a not shown one-stage transmission, and a saw blade 14 is mounted on the drive shaft. The circular saw blade 14 is covered in an upper region by a protective hood 15 which is screwed to the housing 10. The protective hood 15 extends to a support plate 16 which is connected with the machine housing 10. The support plate 16 is used for placing the power tool on the work piece during a sawing process. The circular saw blade 14 extends through the support plate 16 and projects beyond it, downwardly more or less depending on a desired cutting depth.

For adjustment of the cutting depth to the machine, the support plate 16 is turnable about a turning axle which is fixed on the machine housing 10 forwardly on the circular saw blade 14 as seen in a working direction. The selected turning position is fixed by an adjusting device. A second adjusting device 17 is arranged on the support plate 18, and by turning the support plate 16 around a longitudinal axis extending parallel to the saw blade plane, enables a cutting angle adjustment of the power tool.

For providing a two-hand guidance of the power tool for sawing, the power tool has an auxiliary handle 21. It is formed as a bracket handle and arranged forwardly of the drive shaft 13 of the circular saw blade 14 as considered in the working direction of the power tool, near its front region on the machine housing 10. The auxiliary handle which is identified herein below as the bracket handle 21 extends in a plane which is transverse to a plane of the handle 11. Its one handle end is placed on the protective hood 15. Its gripping region 211 which is substantially parallel to the rotary axis of the circular saw blade 14, extends above the support plate 16 at a distance from it. Its another gripping end is fixed on the motor housing 12. Thereby a very solid mechanical connection of the bracket handle 21 on the machine housing 10 is guaranteed.

By means of the auxiliary handle 21, the power tool can be placed very accurately planely on the work piece, and during sawing can be held and guided very well with two hands. The great gripping region of the bracket handle 21 provides an ergonomic and reliable handling of the power tool in all work applications, both for a right-handed and a left-handed person. Moreover, it is possible to support the power tool with the bracket handle 21 in its center of gravity.

Figure 2A:
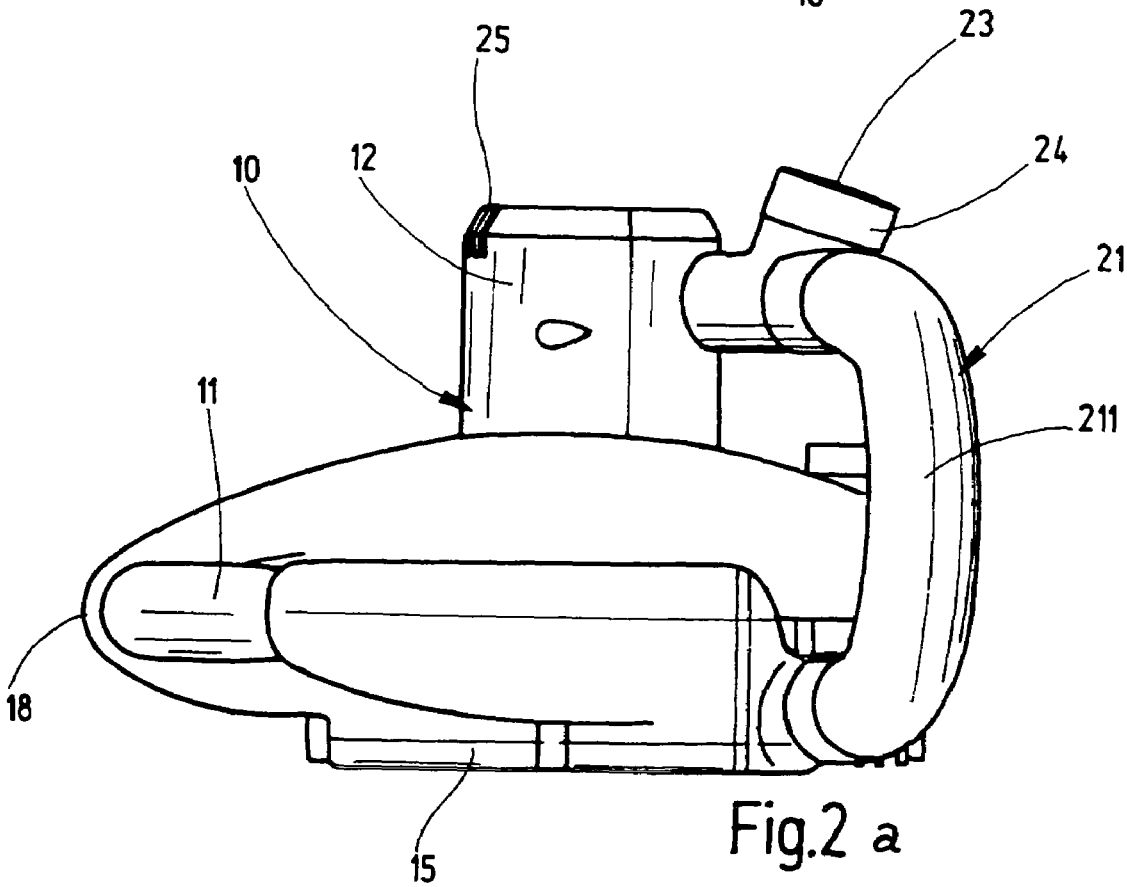
FIGS. 2*a* and 2*b* show a plan view of the electric hand circular power saw of FIG. 1 without a support plate and with a handle in two different positions.
Figure 2C:
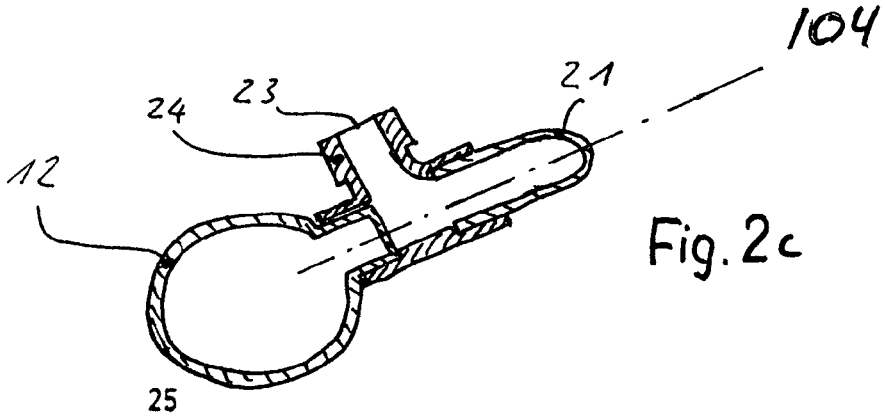
FIG. 2*c* is a view showing a cross section of FIG. 2*b;*
Figure 2B:
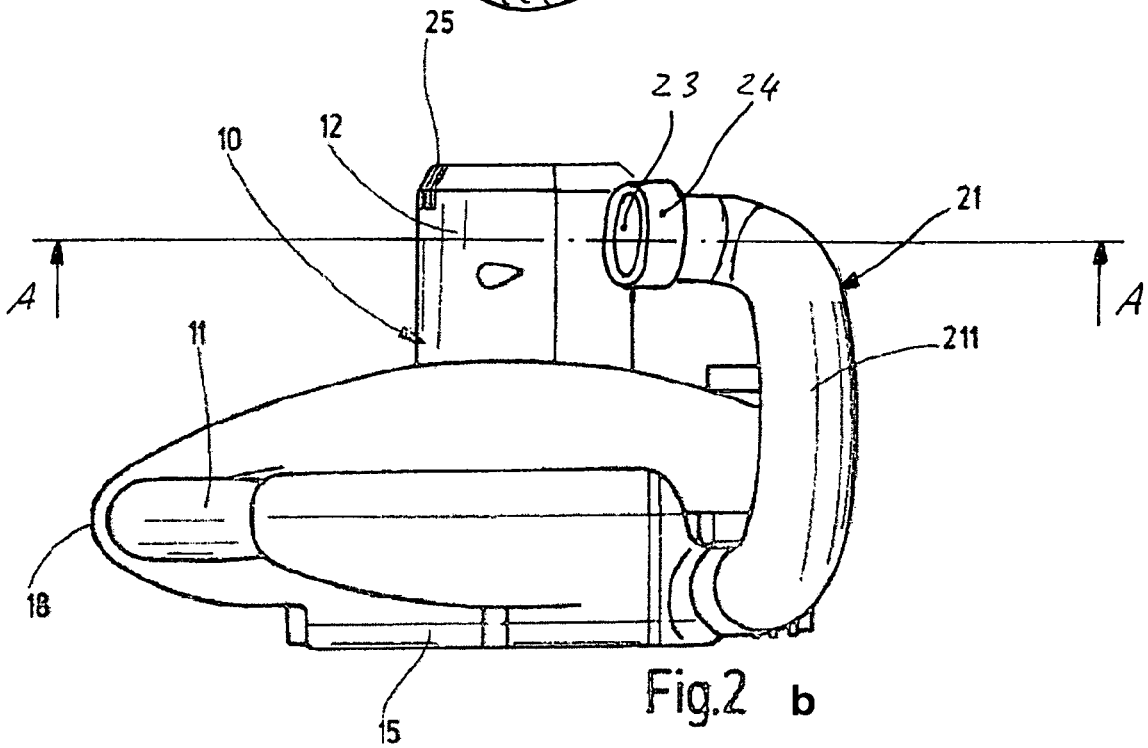
Figure 3:
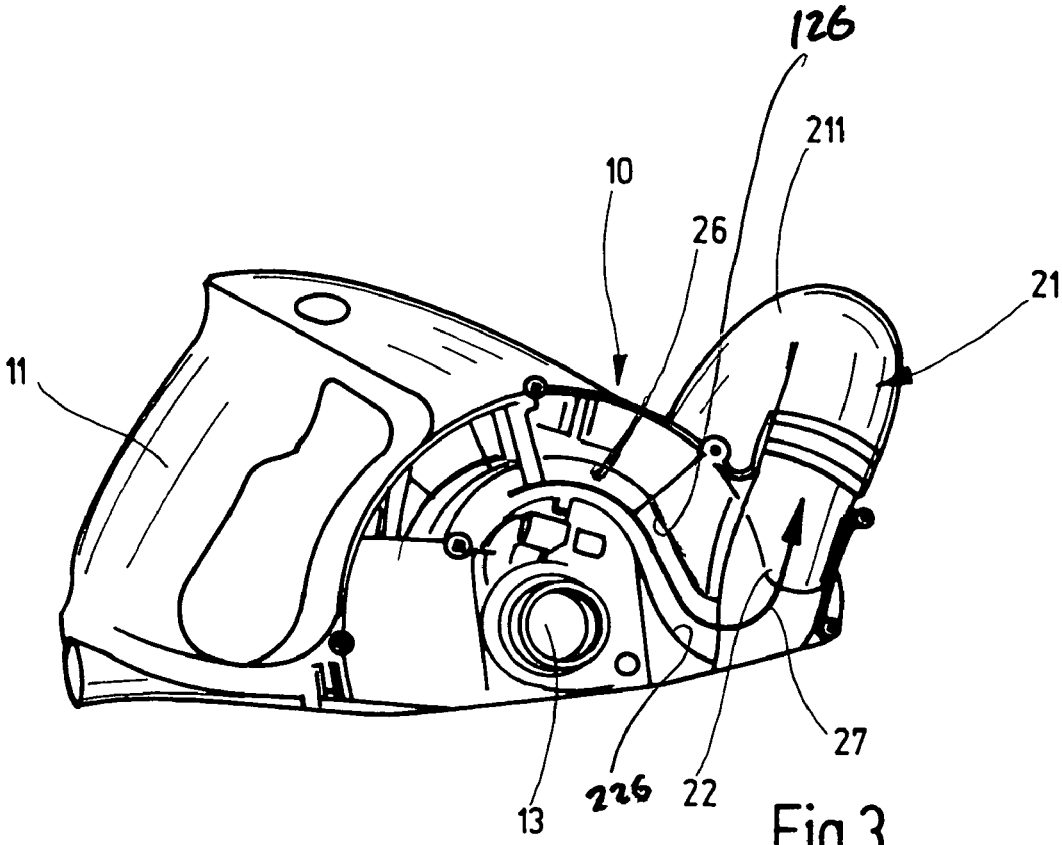
FIG. 3 is a side view of the electric hand circular power saw of FIG. 2 after a removal of the protective hood and a circular saw blade.
Figure 4:
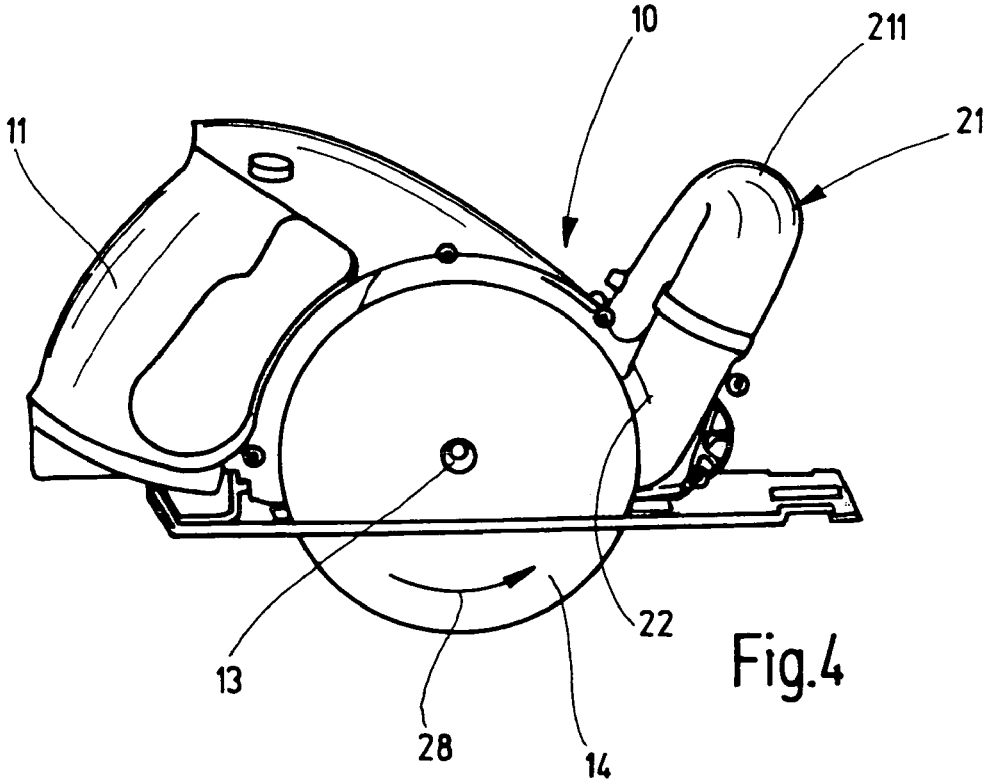
FIG. 4 is a side view of the electric hand power tool of FIG. 1 with a removed protective hood for a circular saw blade.

The bracket handle 21 is hollow and has an inlet 22 which is open to the interior of the protective hood 15 as shown in FIGS. 3 and 4. It also has an outlet 23 arranged behind the handle region 211 as shown in FIGS. 1 and 2. Preferably the outlet 23 is located at or near the end of the bracket handle 21 which faces away from the inlet 22. The outlet 23 is closed by an outlet pipe 24 which can be formed preferably turnable. For the air cooling of the electric motor, the motor housing 12 has air inlet slots 25 shown in FIG. 25. Air which is aspirated by a not shown air impeller connected for rotation with the driven shaft of the electric motor is aspirated through the air inlet slots. The air which is aspirated by the air impeller passes through the electric motor and is blown out as a heat-withdrawing motor spent air, and it is guided so that it flows into the inlet 22 of the hollow bracket handle 21. For this purpose an air passage 26 is formed in the housing 10 and defined by two bow-like side walls 126,226 which keep the motor spent air away from interfering with the saw blade 14 and lead the air undisturbed into the inlet 22 of the bracket handle 21. The air passage 26 is substantially screw-shaped and extends in the shape of a horn. It expands toward the inlet 22 of the bracket handle 21 and opens into the inlet 22 as shown in FIG. 3.

The air is blown by the air impeller from the interior of the electric motor into an air inlet opening of the air passage 26 which is covered in FIG. 3. The motor spent air flows from the motor housing, then enters the protective hood, and next enters the inlet 22 of the bracket handle 21 carrying the debris so as to take away all removed material, as shown by the arrow 27 in FIG. 3, flows then through the air passage 26 of the hollow bracket handle 21, and is discharged through the outlet 23 which is formed in the bracket handle 21 and surrounded by the outlet pipe 24. The outlet pipe 24 forms an extra mouthpiece as a cover for the outlet pipe 23, so that the pipe 24 together with the pipe 23 are swivelable around an axis 104, and therefore the outlet direction can be adjusted. The outlet pipe 24 is oriented so that the flow direction of the motor spent air flowing out here is oriented away from the operator of the power tool. When the outlet pipe 24 is turned, the operator can individually adjust the air discharge device as convenient to him or as necessary for the work applications.

When the electric hand power tool is designed in this way with the special above-described path of air, noises of three sources are diminished, namely the noise of the electric motor, the noise of the motor-cooling fan, and the noise of the saw blade, which are dampened and diminished within the bracket handle 21. Air has time to expand, to relax, and this way to diminish the noises.

Since as mentioned herein above, a one-stage transmission is arranged between the electric motor and the drive shaft 13 of the circular saw blade 14, the rotary directions of the rotor of the electric motor and the circular saw blade 14 are inverted. The rotary direction of the circular saw blade 14 is identified in FIG. 4 by the arrow 28. For supplying the motor spent air which leaves the electric motor to enhance the flow through the air passage 26 into the bracket handle 21, the air passage 26 is closed and formed screw-shaped, as can be seen partially in FIG. 3. It extends from its air inlet opening to the inlet 22 of the bracket handle 21 as an axially expanding spiral, wherein the throughgoing diameter of the air passage 26 is preferably continuously increased.

The two-shell housing 10 is injection molded of synthetic plastic. At least the handle 11 and the air passage 22 are molded together in the same way. The bracket handle 21 is formed as an insert part, but in certain circumstances can be also molded. The screw-shaped air passage 26 which expands toward the inlet 22 of the bracket handle 21 is molded on parts in both shells, so as to complete the air passage 26 when the shells are assembled with one another.

In accordance with a modification of the above described electric hand circular power tool, the bracket handle 21 is formed turnable around its inlet 22 and is arrestable in any of adjusted turning positions. Thereby, in addition to the possibility of adjusting the noise radiating direction, also an ergonomic effect is obtained.

The invention is not limited to the specific electric hand circular power saw. It can be used for all hand-guided electric power tools with rotatable tools such as for example masonry, rock saws, angle grinders, concrete grinders, eccentric grinders, etc.

It will be understood that each of the elements described above, or two or more together, may also find a useful application in other types of constructions differing from the types described above.

While the invention has been illustrated and described as embodied in electric hand power tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. An electric hand power tool, comprising;

a housing;

an air-cooled electric motor which is accommodated in said housing;

a tool which is driven by said electric motor;

a protective hood which at least partially covers said tool;

said housing having a handle end an auxiliary handle for a two-hand guidance of the hand power tool, said auxiliary handle being positioned in a plane transverse to a plane of said first-mentioned handle and, with reference to a work direction, before said first-mentioned handle, said auxiliary handle being completely hollow and having an inlet communicating with said protective hood so as to carry motor cooling air which has left said housing and passed said protective hood for the tool, wherein said motor cooling air then flows into said inlet of said auxiliary handle, thereby carrying debris away from said electric hand power tool and through said auxiliary handle and out of the auxiliary handle wherein said auxiliary handle is operative for damping a flow noise of said air from said electric motor, from a motor-cooling fan and from said tool;

further comprising an air passage formed in said housing and having an air inlet opening provided for the motor cooling air and opening into said inlet of said auxiliary handle, wherein said air passage expands toward said inlet of said auxiliary handle.

2. An electric hand power tool as defined in claim 1, wherein said auxiliary handle has an outlet formed at a handle end which is remote from said housing.

3. An electric hand power tool as defined in claim 2; and further comprising an outlet pipe which surrounds said outlet.

4. An electric hand power tool as defined in claim 3, wherein said outlet pipe is formed turnable.

5. An electric hand power tool as defined in claim 2, wherein said inlet of said auxiliary handle is arranged in said protective hood, and said air passage opens in said protective hood directly at said inlet of said auxiliary passage.

6. An electric hand power tool as defined in claim 1, wherein said hollow auxiliary handle is formed as a bracket handle which is placed with one handle end at said protective hood, and at or near its another handle end is fixed on a housing part of said housing which receives said electric motor.

7. A hand power tool, comprising a housing; an air-cooled motor which is accommodated in said housing; a tool which is driven by said motor a protective hood which at least partially covers said tool; said housing having a handle and an auxiliary handle for a two-hand guidance of the hand power tool, said auxiliary handle being positioned in a plane transverse to a plane of said first-mentioned handle and, with reference to a work direction, before said first-mentioned handle, said auxiliary handle being completely hollow and having an inlet communicating with said protective hood so as to carry motor cooling air which has left said housing and passed said protective hood for a tool and then flows into said inlet of said auxiliary handle and through said auxiliary handle outwardly, so that said auxiliary handle being operative for damping a flow noise of said air.

* * * * *